United States Patent [19]

Barlow et al.

[11] 4,027,423

[45] June 7, 1977

[54] DOLL WITH OVERSIZE SHOES AND SECURING MEANS THEREFOR

[75] Inventors: Gordon A. Barlow, Skokie; Allison W. Katzman, Chicago, both of Ill.

[73] Assignee: Marvin Glass & Associates, Chicago, Ill.

[22] Filed: June 2, 1975

[21] Appl. No.: 583,120

[52] U.S. Cl. ..... 46/116; 46/32

[51] Int. Cl.[2] ..... A63H 3/36

[58] Field of Search ..... 46/115, 116, 151, 158, 46/163, 32; 63/3, 15.6

[56] References Cited

UNITED STATES PATENTS

| | | | |
|---|---|---|---|
| 1,211,771 | 1/1917 | Singer | 46/116 |
| 2,013,395 | 9/1935 | Wood | 46/151 UX |
| 2,580,746 | 1/1952 | Feldman | 46/116 X |
| 3,481,155 | 12/1969 | Cook | 63/3 |
| 3,693,376 | 9/1972 | Willner | 63/15.6 |
| D232,965 | 9/1974 | Atwell | 63/15 X |

FOREIGN PATENTS OR APPLICATIONS

| | | | |
|---|---|---|---|
| 981,765 | 1/1951 | France | 63/3 |

OTHER PUBLICATIONS

*The Blue Book Store*, published 1927 by Norris, Alister-Ball Co., Chicago, 3rd page of insert between pp. 220–221 relied on.

Mattel Toy Catalog© 1966 by Mattel, Inc., Hawthorne, California pp. 21, 22, 25, 30 relied on.

*Primary Examiner*—F. Barry Shay

*Attorney, Agent, or Firm*—Mason, Kolehmainen, Rathburn & Wyss

[57] ABSTRACT

A participating figure toy or doll, and accessory items of clothing and the like therefor, so that a child or other user may adorn the doll with the various items of attire to imitate a child playing a dress-up game with the doll wearing oversized or "adult" clothing. The accessory items include a hat, a necklace, a purse, a bracelet, a ring, a shawl, and a pair of shoes, all of which are of oversided or of exaggerated proportions relative to the size and shape of the doll.

4 Claims, 4 Drawing Figures

Fig 1
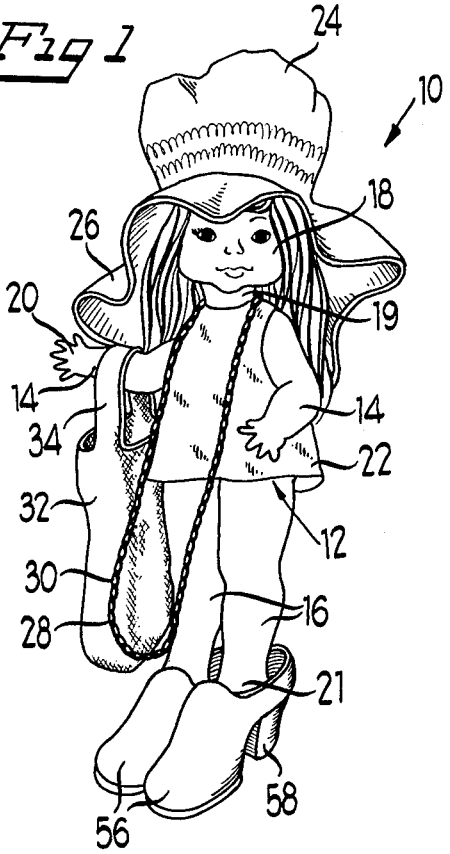
Fig 2
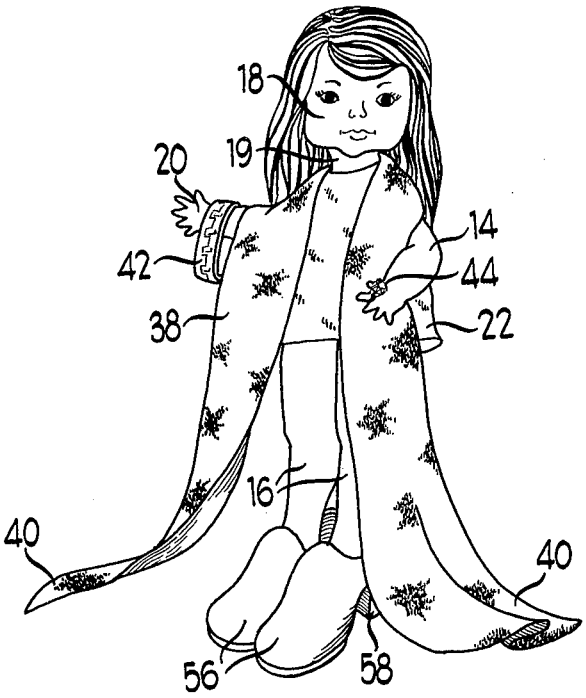
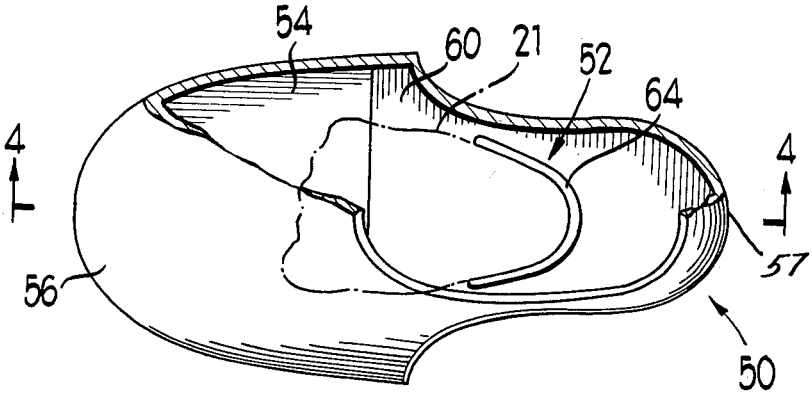
Fig 3
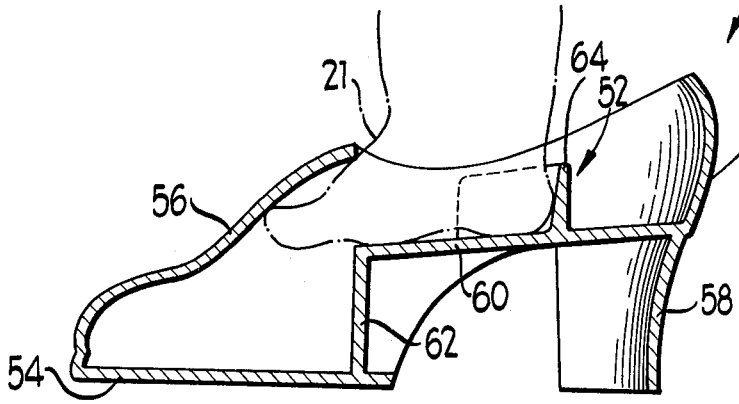
Fig 4

DOLL WITH OVERSIZE SHOES AND SECURING MEANS THEREFOR

BACKGROUND OF THE INVENTION

1. Field of the Invention

The present invention relates to figure toys and in particular to a figure toy in the form of a doll having suitable accessory items of attire for placement on the figure toy.

2. Description of the Prior Art

Figure toys have been provided for use in combination with a various number of accessory items. Such accessory items have included clothing, vehicles, appliances, pet animals and the like. However, all of the accessory items which have been designed for a particular figure toy or doll have been provided and manufactured with the size and proportion of the figure toy in mind so that the accessory items are correctly proportioned relative to the figure toy to fit or properly cooperate therewith.

SUMMARY OF THE INVENTION

It is an object of the present invention to provide a novel figure toy and accessory items for use in combination therewith.

In accordance with the concepts of the present invention, a figure toy is provided having a torso portion having a pair of arms, a pair of legs, and a head mounted thereon with hands and feet provided for the arms and legs, respectively. A set of accessory items including a hat, a necklace, a purse, a bracelet, a ring, a shawl, and a pair of shoes are provided having oversized or exaggerated proportions relative to the size and shape of the figure toy so that when used with or adorned on the figure toy the accessory items provide a doll having the appearance of a young or small child playing "dressup" in adult attire. The shoes have retaining means on the inside thereof to hold the shoes on the doll's feet.

Other objects, features and advantages of the invention will be apparent from the following detailed description taken in connection with the accompanying drawings.

BRIEF DESCRIPTION OF THE DRAWINGS

FIG. 1 is a perspective view of the figure toy of the present invention including the oversized accessory items of a hat, a necklace, a purse, and a pair of shoes;

FIG. 2 is a perspective view, similar to FIG. 1, showing the figure toy adorned with a shawl, a bracelet, a ring, and the pair of shoes;

FIG. 3 is a fragmentary, top plan view, on an enlarged scale, of one of the shoes of FIG. 1 with the foot of the figure toy shown in phantom; and FIG. 4 is a vertical section of the shoe of FIG. 3, taken generally along line 4—4 of FIG. 3.

DESCRIPTION OF THE PREFERRED EMBODIMENT

The present invention is in the form of a doll and doll accessories, generally designated 10, which are shown in various combinations in FIGS. 1 and 2. The doll includes a torso portion 12, a pair of arms 14, a pair of legs 16 and a head 18 mounted by a neck 19 onto the top of the torso 12. Hands 20 and feet 21 are provided on the end of the arms 14 and legs 16, respectively. In the preferred embodiment, the doll is representative of a girl having a proportionately fitting dress 22.

The accessories for use with the doll of the present invention include a hat 24 of exaggerated or oversized proportion relative to the size and shape of the doll to give the appearance of a child (the doll) imitating her mother or other adult by wearing an adult's apparel. Particularly, the hat 24 includes a wide, flexible brim 26 which droops downwardly over the head of the doll generally at the shoulders thereof.

Referring again to FIG. 1, a necklace accessory 28 is provided for the doll of exaggerated length so that when placed or hung about the neck 19 of the doll, the necklace 28 extends down to the legs of the doll. As shown, the necklace extends almost to the feet of the doll when placed in a standing or upright position. The necklace 28 can be manufactured of many suitable materials. In the preferred embodiment the necklace includes a plurality of beads 30 which are threaded or strung onto a suitable string or chain.

Another type of accessory contemplated by the present invention is a purse 32 having a handle 34 for supporting the purse 32 on the arm 14 or shoulder of the doll. Again, the purse 32 and handle 34 are of oversized or exaggerated proportions relative to the size and shape of the doll 10 (as shown, extending down to the ankle of the doll) to provide the desired appearance of a child using an adult's accessories.

Referring to FIG. 2, another one of the accessories contemplated by the present invention is a shawl 38 of exaggerated length such that when draped about the torso and arms of the figure toy the ends 40 of the shawl 38 will engage and "drag" on the supporting surface when the doll is in an upright or standing position. Similarly, a bracelet 42 is provided for use with the doll and has a diameter which is several times as large as the diameter that would be required to slip over the hand 20 of the doll. An accessory ring 44 also is provided for mounting on one of the fingers of the hand 20 of the doll. Preferably, the stone or other decorative portion of the ring is oversized or exaggerated in proportion relative to the size of the doll's hand and fingers so as to appear to be a ring suitable for use by an adult person. The finger grasping or mounting portion of the ring 44 may be provided in a much reduced size relative to the size of the stone so as to enable the ring 44 to stay on the small fingers of the doll. Alternately, a smaller mounting ring (not shown) for the doll's finger may be formed within a larger ring portion proportionate to the stone portion of the ring.

A pair of shoes, generally designated 50 in FIGS. 3 and 4 is provided for mounting on the feet 21 of the doll. More particularly, referring to FIGS. 3 and 4, the shoes 50 are again provided with an exaggerated or oversized proportion in relation to the size of the doll 10 so as to give the appearance of a child wearing, for example, her mother's shoes. The shoes 50 include retaining means generally designated 52, for attachment to the feet of the doll. More particularly, the shoes are formed generally in the shape of a modified high heel having a sole portion 54, a top or body portion 56 having a back portion 57 and a raised or elevated heel portion 58. The retaining means 52 includes a generally horizontal foot engaging platform portion 60 which is supported above the sole by a generally perpendicular support flange 62 and which also forms the top end of the heel 58. A generally upstanding, arcuate flange 64 is provided approximately at the midpoint of the foot engaging platform portion 60 to engage the rearwardly directed surfaces of the heel of the foot 21 of the doll so as to hold the foot 21 forwardly into engagement with the undersurface of the shoe top 56 to maintain the shoe attached to the foot 21 of the doll by the frictional forces generated by the wedging effect created by the flange 64. Thus, the shoes 50, which are extremely oversized for the particular foot 21 of the doll are maintained thereon while giving the appearance of a much exaggerated or oversized shoe.

The doll can be used in combination with one or more of the accessory items described above to provide a doll or figure toy which provides the image of a child being adorned with a suitable adult's attire. Of course, as shown and and described with reference to the female or girl doll, other oversized accessory items can be provided pertaining to a doll of either sex departing from the spirit of the present invention.

The foregoing detailed description has been given for clearness of understanding only and no unnecessary limitations should be understood therefrom as some modifications will be obvious to those skilled in the art.

We claim:

1. A user participation toy, comprising:

a figure toy in the form of a doll having a torso portion and appendages including a pair of arms, a pair of legs, a head portion mounted to the torso portion, and a pair of feet mounted at the base of said legs; and a pair of shoes for use with and positionable on said doll, said shoes being of oversized proportions relative to the feet at the ends of said doll legs, each of said shoes including a sole, a back portion with an inwardly facing surface and means for securing said feet to the relatively larger shoes in a position spaced forwardly from said back portion and in an elevated position relative to the sole of the shoes.

2. The toy of claim 1 wherein said mounting means includes an elevated platform and a generally upstanding flange mounted on said platform in a position spaced forwardly of said back portion surface for engagement about at least a portion of a foot of the doll for frictionally holding the foot within the flange.

3. The toy of claim 2 wherein each shoe has an upper body portion, said upstanding flange being disposed within the shoe and engageable with the heel of the doll's foot.

4. A user participation toy, comprising:

a figure toy in the form of a doll having a torso portion and appendages including a pair of arms, a pair of legs, and a head portion mounted to the torso portion; and a plurality of accessory items for use with and positionable on the doll, including a hat having oversized proportions relative to the doll's head, a necklace of oversized proportions relative to the doll's neck portion, a purse having oversized proportions relative to the doll's torso, a shawl of oversized proportions relative to the size of the doll so as to extend down substantially to the feet of the doll, and a pair of shoes of oversized proportions relative to the feet of the doll, each of said shoes including a sole, a back portion and means for securing said shoes to the relatively smaller feet, said means including a platform supported above the sole of the shoes and a flange on said platform spaced from the back portion of said shoes for engaging the feet for frictionally holding the shoe on the feet of the doll, said accessory items all having exaggerated proportions with respect to the size of the doll whereby a user may use the doll and accessory items to simulate a child playing "dress-up" in oversized, simulated adult attire.

* * * * *